US008069501B2

(12) United States Patent
Casson et al.

(10) Patent No.: US 8,069,501 B2
(45) Date of Patent: Dec. 6, 2011

(54) DEODORIZING TOILET SEAT

(76) Inventors: Justin Casson, Princeton, NJ (US); Ron Lessard, Princeton, NJ (US)

( * ) Notice: Subject to any disclaimer, the term of this patent is extended or adjusted under 35 U.S.C. 154(b) by 568 days.

(21) Appl. No.: 12/259,754

(22) Filed: Oct. 28, 2008

(65) Prior Publication Data

US 2010/0101008 A1 Apr. 29, 2010

(51) Int. Cl.
*A47K 13/00* (2006.01)

(52) U.S. Cl. ..... 4/217; 4/237

(58) Field of Classification Search ..... 4/213, 217, 4/218, 209 R, 209 FF, 234–237
See application file for complete search history.

(56) References Cited

U.S. PATENT DOCUMENTS 3,659,296 A 5/1972 Stamper
4,748,698 A * 6/1988 Kao ..... 4/217
5,079,783 A 1/1992 Haletsky et al.
5,355,536 A 10/1994 Prisco
5,797,148 A * 8/1998 Kivela ..... 4/235
6,546,567 B2 4/2003 Kuzniar
6,823,532 B1 11/2004 Anderson
2005/0050622 A1 * 3/2005 Kelly ..... 4/217
2007/0163033 A1 7/2007 Kelly

* cited by examiner

*Primary Examiner* — Gregory Huson
*Assistant Examiner* — Janie Christiansen
(74) *Attorney, Agent, or Firm* — Gore & Associates, P.L.L.C.

(57) ABSTRACT

A toilet seat for filtering foul air includes large capacity internal ducting connected between a very large intake opening and a large exhaust for efficient, high capacity air filtration. The seat comprises an assembly including upper and lower halves joined along a horizontal seam. The seat halves pivot on an axle and are biased apart to sense use of the device to control its on/off timing. The device is activated as the user sits on the seat and is programmed by a controller to continue for a length of time after toilet use.

11 Claims, 4 Drawing Sheets

13
16
14
17
19
25
17
20
21
14
16
23
22
15

DEODORIZING TOILET SEAT

FIELD OF THE INVENTION

The present invention relates to the deodorizing of noxious fumes in a toilet. More specifically, it relates to a self-contained, air-filtration system fully contained in a toilet seat.

BACKGROUND OF THE INVENTION

There have been various attempts to provide odor control systems in toilet seats to deodorize the foul air in toilets created during their use. Some of these systems have included specially designed toilet seats that include air filtration systems. It is known, for example, to provide a toilet seat with a hollow body which includes air intake, ducting and exhaust with the filtering system, such that air is drawn in from the toilet bowl into the toilet seat duct and deodorized, thereafter being exhausted through a rear portion of the seat. Such a device is disclosed, for example, in U.S. Pat. No. 6,823,532 issued to Anderson entitled "Malodor Control Systems for Toilets" which relies on a water spray to treat the foul air. This is a complicated device comprising a pressurized water feed line and provides only limited air handling capacity. Another system is disclosed in U.S. Patent Publication 2007/0163033 by Kelly entitled "Toilet Seat" This document discloses a toilet seat which is a fully self-contained air filtration system that includes batteries for powering fan units to move air through internal ducting. The toilet seat of this invention is provided with a microswitch which is switched by force applied to the seat by the weight of a person sitting down. Thus, the fan units are energized only when needed.

Despite these attempts in the art to provide an effective deodorizing self-contained battery-powered toilet seat, deficiencies still remain. Most importantly, prior art toilet seat deodorizing systems lack the sufficient volume of air flow to adequately deodorize foul toilet vapors. There is therefore still a need in the art for an effective deodorizing toilet seat.

SUMMARY OF THE INVENTION

In order to solve the problems in the art, the present deodorizing toilet seat has been devised. In accordance with the present invention, a toilet seat includes a large-capacity internal ducting connected between a very large intake opening and a large exhaust opening. Efficient, high-capacity fans are utilized to move a large volume of air through a filtering system providing a flow capacity not heretofore achievable by the prior art. An air handling system located within the apparatus simultaneously filters and scents foul air emanating from the toilet bowl. The unit is activated as the user sits on the seat and is programmed to continue its function for a controlled length of time after toilet use. Upon actuation, as the user is seated, the fan(s) draw foul air through the air inlet and filter(s) and then expels the treated air toward the rear and sides of the toilet via the exhaust vents. The invention is composed of a seat assembly comprising upward and lower halves joined along a horizontal seam. Contained within the seat assembly is the ventilation system. The components of the ventilation system are an air inlet, at least one filter, at least one fan, a circuit board, a battery pack connected to the circuit board, and at least one exhaust vent. The seat assembly shell forms the passageways to process the foul air. Contained within the seat assembly are mechanisms to provide the user with easy access to clean and maintain the device.

The seat assembly includes an outer shell composed of two mating halves, an upper case half and a lower case half. Both the upper case and lower case pivot on the axle, allowing the upper case to swing away from the lower case. The upper case and lower case snap together at a latch point at the front of the seat. The cases are joined by snap-fit and can be snapped apart to facilitate access to the internal duct for cleaning purposes. Further, due to a spring action, the latch allows the upper case to pivot a controlled distance. This resulting vertical displacement, or movement downward of the upper case as the user is seated, actuates a micro switch connected to the circuit board which initiates the ventilation cycle. Upon release of pressure on the upper case, as the user stands, the ventilation flow continues for a prescribed amount of time, after which power to the fan is interrupted and the ventilation cycle is complete.

More specifically, the invention comprises a air filtering toilet seat being an annular seat having mounting means for hingably connecting the seat to a top opening of the toilet bowl. An internal compartment lies between an upper seat case and a lower case which are joined along overlapping sidewalls. An air duct within the compartment conducts a flow of air from an inlet opening at the front of the seat to an exit duct at the rear of the seat. The inlet opening lies along an inside wall of the seat and spans a substantial portion of the seat between overlapping sidewalls along a seam between the seat halves. Filters for deodorizing foul air from the toilet bowl are arranged in the duct such that all of the flow of air passes through the filters. Fans downstream of the filters is arranged in the duct creating the flow of air along the duct and through the filters. Process control circuitry on a circuit board within the compartment at the rear of the seat controls operation of the fan which is powered by a battery which is also within the compartment but located within a section isolated from the duct. The filters are removably arranged in the duct by way of flanges at the downstream ends of the filters having opposing side edges which are slidably engaged slots in the inside wall of the duct. The bodies of the filters are substantially tubular and lie longitudinally along channels of the duct. Operation of the seat is activated by sensing the presence of a human body on the seat which can be supplied by a microswitch activatable by movement by the upper seat half with respect to the lower seat half caused by the weight of the human body.

The invention provides several advantages over the prior art. It is easy to install and as simple as changing a normal toilet seat. The usual mounting bolts are located at the rear. The invention requires no exhaust to the outdoors and is particularly suitable to enclosed environments. The invention is exceedingly simple and easy to maintain without harboring foul-smelling contaminants within the seat. Because the odors are filtered at the source, the device requires a minimum amount of energy, which contributes to long battery life. Other objects and advantages of the invention will be apparent to those of skill in the art from the following drawings and description of the preferred embodiment.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DESCRIPTION OF THE PREFERRED EMBODIMENT

Figure 1:
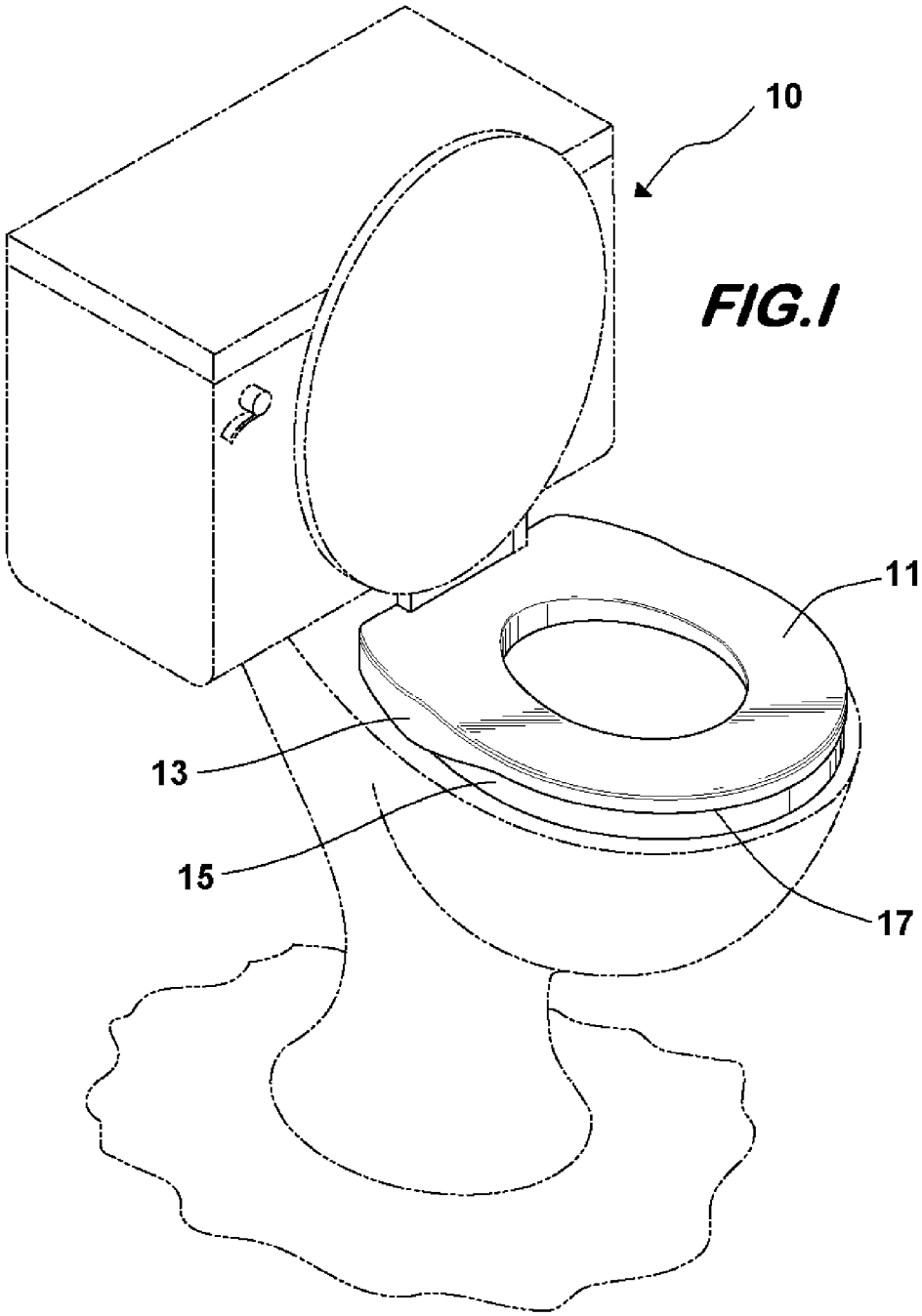
FIG. 1 is a top-left isometric view of the invention installed on a toilet which is shown in phantom.

Referring now to FIG. 1, the toilet seat of the invention 11 is seen mounted on a typical toilet 10 in the usual position of a normal toilet seat, having the same general shape and configuration and approximate size. As will be more fully described herein, the seat comprises an upper seat case half 13 and a lower seat case half 15 separated by a substantially horizontal overlapping seam 17.

Figure 2:
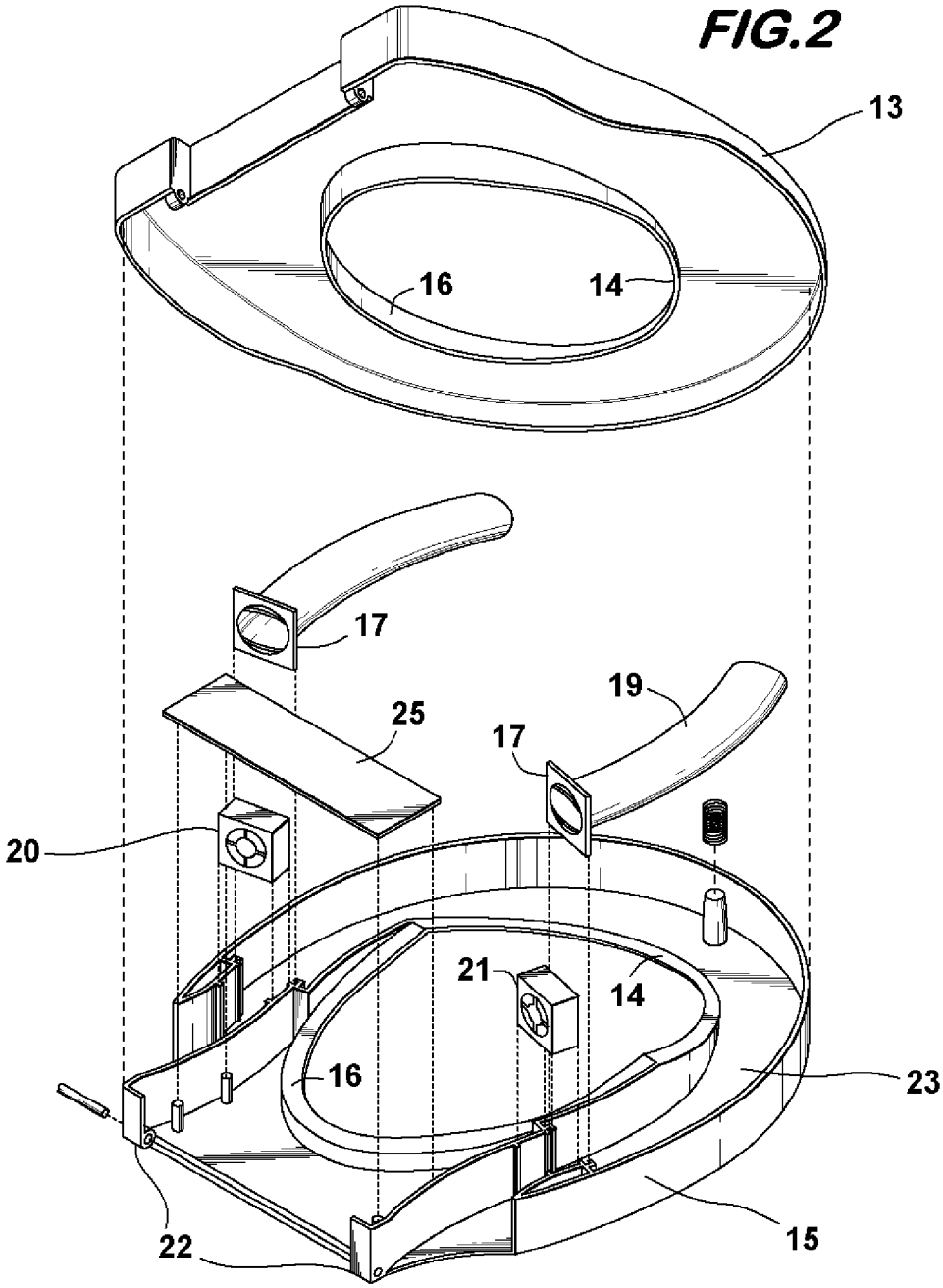
FIG. 2 is a left-rear isometric assembly view.

Referring now to FIG. 2, basic elements of the invention are shown. The upper seat half 13 partially surrounds the lower seat half and is hingably connected to the lower seat half 15 by way of hinge means 22. The lower seat half includes a channel 23 which when mated with a similar channel in the top seat half forms an internal compartment between them. Spring 24 biases the case halves apart from a fully collapsed position to an extended position. This provides a resilient movement of the seat which in turn operates a microswitch (not-shown) to detect the presence of a user on the seat. The seat halves include cutouts along the front of their inner walls 16 which form a large inlet opening 14 at the front of the seat as more clearly shown in FIGS. 3 and 4. Identical components of the ducting and air filtration system are symmetrical about a front-to-rear center line. A forward portion of the compartment encloses filters 19 which are releasably held in the compartment by way of flanges 17 that slideably engage cooperating slots in the duct. Similarly, fans 20 and 21 are releasably held at the rear of the ducts by slideable fitment with slots in the duct. In an isolated portion of the compartment at the rear of the seat, a circuit board 25 which controls operation of the fans is secured. The circuit board is electrically connected to the fans and further includes a microswitch which is operative to indicate movement to the upper seat half 13 with respect to the lower seat half 15. The circuit board assembly is attached to the lower half of the seat assembly, and is sealed within the lower case by a cover plate. The circuit board is composed of the electronic devices that control the ventilation system. This includes a switch, timing devices, battery holder, and other electronic elements.

Figure 3:
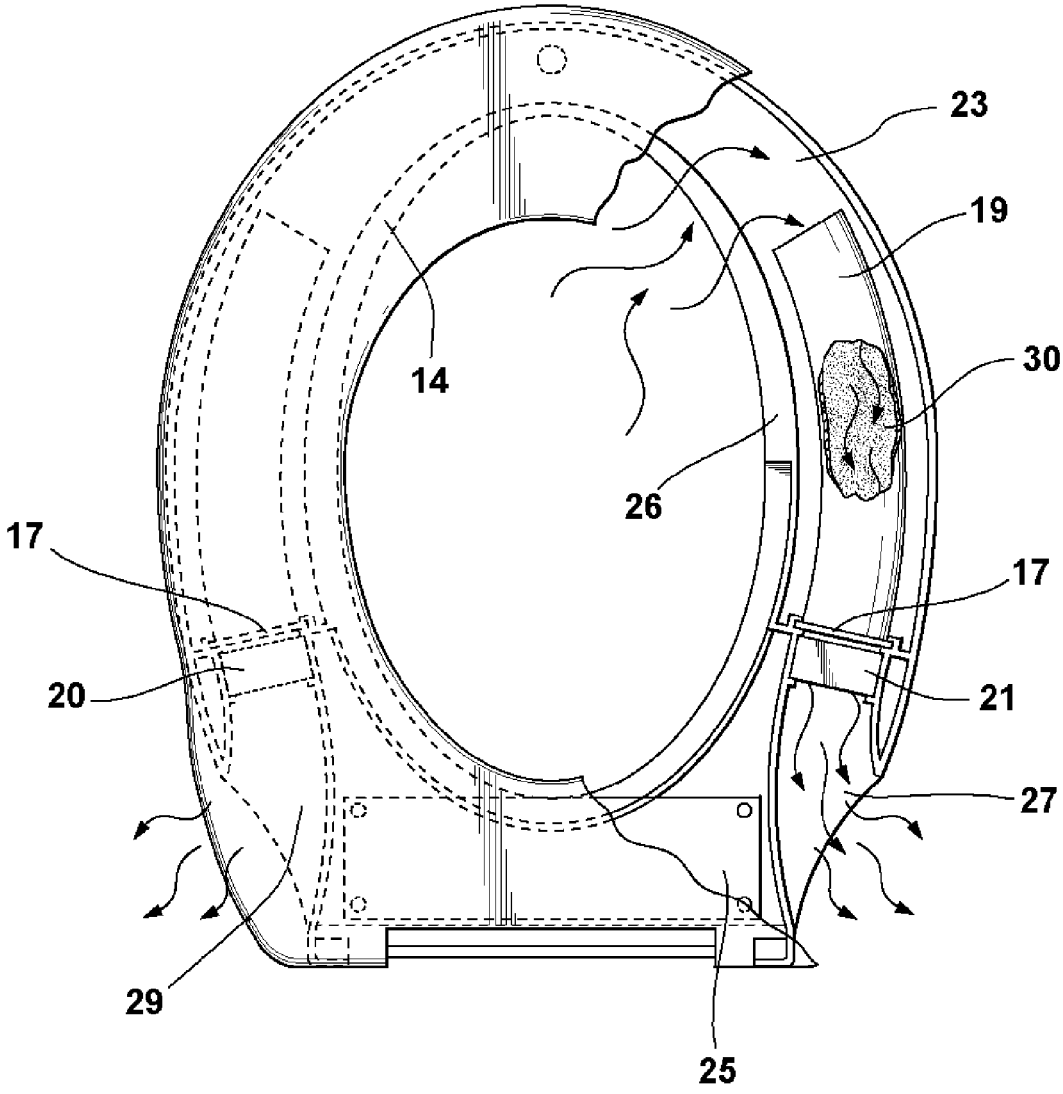
FIG. 3 is a top-plan partial sectional view.

Referring now to FIG. 3, fans 20 and 21 create the air flow from the inlet duct 14 in the front of the seat's inside wall 26 into channel 23 and through filter 19. The filtering chambers contained within the seat assembly use activated charcoal 30 to treat the air as it passes through filter layers. The filtering system is composed of at least one filter. The filters have an outer porous membrane through which air passes. The filters are self-contained, coming in contact with the seat assembly via the flanges. Activated charcoal is located within the filter chambers in such a manner as to allow air to be drawn through, but to come in contact with the activated charcoal as it passes through the filtering chambers. The filters are disposable. They are replaceable by the user, once said filters are exhausted. Contained within the filtering chambers described above, are porous membranes that contain agents to scent the air that passes through the filtering chamber.

Foul air is drawn in through inlet opening 14 and the filtered air is then exhausted at the rear of the seat through outlet duct 27. Since components of the seat are symmetrically arranged on opposite sides, the duplicate arrangement of components and flow of air just described will be understood to apply to the opposite side of the seat as well. The location of the exhaust vents, to the rear and sides, helps to direct air away from the user. Urine over-spray is not allowed to collect in the vents. Regardless, any unusual contamination of the vents is easily cleaned by wiping down, and thoroughly accomplished by disengaging the upper case from the lower case. Here again, there are no small apertures to collect and harbor urine or other matter. The generous size of the outlet ducts 27 and 29 helps to keep any reduction in airflow to a minimum, further increasing the efficiency of the unit.

Figure 4:
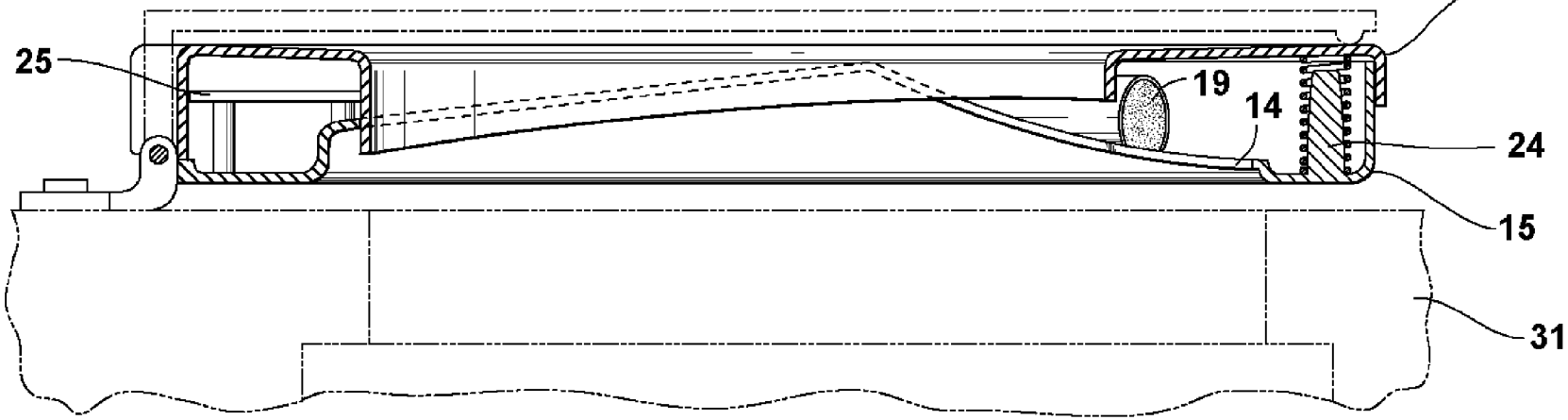
FIG. 4 is a left-side elevation sectional view taken from FIG. 1 as shown in that Figure.

Referring now to FIG. 4, the unusually large size of inlet duct 14 as well as its shape and location will be better appreciated. Emphasis is placed upon the size of the intake, calculated at approximately 19 square inches, so that a minimal amount of restriction is imparted to the flow of the foul air emanating from within the toilet bowl, and through filter 19. A tight seal of the seat assembly to the toilet bowl 31 is not necessary with this design, due to the large air intake, eliminating fitting problems with most toilet bowl configurations. The resulting smooth and unencumbered surface, therefore, allows for easy cleaning and maintenance of the underside of the unit. The location of the intake 14, to the front of the unit, helps prevent foul air from rising where it would be most easily detected. Additionally, and as previously mentioned, the location away from the rear of the unit, helps to ensure that urine over-spray from a standing user, with the seat in the upright position, is not allowed to be collected by the ventilation system. Spring means 24 biases the case halves 13 and 15 slightly biased apart so that there will be movement between the two caused by the weight of the user which can be detected by sensing means on the circuit board 25 comprises a microswitch. The fans will then be provided power from battery means located in the circuit board compartment by control circuitry on the circuit board to operate the fans for a prescribed period of time after the sensing means has signaled that the user has left the seat.

From the foregoing description of the preferred embodiment, the advantages of the invention will be apparent. The large open nature of the air intake is such that cleaning is simple and convenient. All interior surfaces of the air intake are accessible and easily wiped clean. Normal cleaning of the seat assembly is accomplished as easily as for a conventional toilet seat. There are no small apertures to trap urine or other matter. The shape is such that foul elements are allowed to be shed rather than collected and harbored, as a series of small apertures would do. The flanges formed along the inner edges of the upper and lower cases of the seat assembly direct urine spray down and into the toilet bowl. This is especially important in guarding against the collection of miss-directed urine spray by a standing user when the seat is in an upright position. Wherein small apertures, especially if located to the rear of the toilet seat, collect and harbor urine over-spray. Under these circumstances, this design with the built-in flanges, helps to shed over-spray. Further, and due to the ease of the separation of the upper case from the lower case of the seat assembly, any urine that does manage to seep beyond the flanges is easily wiped clean upon disengagement of the upper and lower cases. In addition, urine over-spray and splash from a seated user is also easily cleaned, being accomplished simply by wiping down the accessible surfaces. Disengagement of the upper and lower cases, exposes the interior, and allows for easy clean up.

It should be understood that there may be other modifications and changes to the present invention that will be obvious to those of skill in the art from the foregoing description, however, the present invention should be limited only by the following claims and their legal equivalents.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air filtering toilet seat, comprising:

An annular seat having mounting means for hingably connecting said seat to a top opening of a toilet bowl;

an internal compartment lying between an upper seat case half movably engaged with and partially surrounding a lower seat case half which are joined along a substantially horizontal seam between laterally overlapping inner and outer sidewalls of the case halves;

an air duct within the compartment for conducting a flow of air from an inlet opening at a front of the seat to an exit duct at a rear of the seat, said inlet opening lying along the inner side wall of said seat and spanning a substantial portion of the seat along said seam;

at least one filter for deodorizing foul air from the toilet bowl arranged in the duct such that the flow of air passes through the filter;

a fan downstream of said filter arranged in the duct for creating the flow of air along the duct and through the air filter;

a circuit board within said compartment at the rear of the seat for controlling the operation of said fan; and a battery within said compartment located adjacent said circuit board for providing electrical power to the fan.

2. The toilet seat of claim 1 further including means for arranging said filter in the duct comprising a planar flange at the downstream end of the filter, said flange having opposing side edges located on opposite sides of said filter which slidably engage slots in an inside wall of the duct.

3. The toilet seat of claim 2 wherein said filter is elongate and tubular and lies coaxially along a channel of said duct.

4. The toilet seat of claim 3 wherein said circuit board and battery are located in an electrical component section of said compartment isolated from said duct.

5. The toilet seat of claim 4 further including means for sensing the presence of a human body on the seat.

6. The toilet seat of claim 5 wherein said presence sensing means is a microswitch located entirely within the seat activatable by movement of said upper seat half with respect to said lower seat case.

7. The toilet seat of claim 2 wherein said fan is releasably fitted to said duct by engagement with the slots in the inside wall of the duct.

8. The toilet seat of claim 3 wherein said filter contains activated charcoal.

9. The toilet seat of claim 5 wherein process control circuitry on said circuit board controls the fan to continue operation for a prescribed time after the body has left the seat.

10. The toilet seat of claim 1 further including a filtered air outlet duct emanating from said compartment in the side of the seat at the rear.

11. The toilet seat of claim 1 further including a second air duct in symmetrical counter position to said first air duct and lying along said compartment on an opposite side of said seat from said first air duct and further including second filter and second fan means within said second air duct operating in parallel, each of said air ducts individually drawing air from said inlet opening.

* * * * *